US010197063B2

(12) United States Patent
Nakaniwa et al.

(10) Patent No.: US 10,197,063 B2
(45) Date of Patent: Feb. 5, 2019

(54) CENTRIFUGAL FLUID MACHINE

(71) Applicant: MITSUBISHI HEAVY INDUSTRIES COMPRESSOR CORPORATION, Minato-ku, Tokyo (JP)

(72) Inventors: Akihiro Nakaniwa, Tokyo (JP); Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 736 days.

(21) Appl. No.: 14/770,637

(22) PCT Filed: Mar. 6, 2014

(86) PCT No.: PCT/JP2014/055870
§ 371 (c)(1),
(2) Date: Aug. 26, 2015

(87) PCT Pub. No.: WO2014/148274
PCT Pub. Date: Sep. 25, 2014

(65) Prior Publication Data

US 2016/0017888 A1 Jan. 21, 2016

(30) Foreign Application Priority Data

Mar. 21, 2013 (JP) ..... 2013-058899

(51) Int. Cl.
*F04D 17/12* (2006.01)
*F04D 29/42* (2006.01)
(Continued)

(52) U.S. Cl.
CPC ..... *F04D 17/12* (2013.01); *F04D 17/122* (2013.01); *F04D 29/0516* (2013.01);
(Continued)

(58) Field of Classification Search
CPC .... F04D 17/12; F04D 17/122; F04D 29/0516; F04D 29/286; F04D 29/4206; F04D 29/441; F04D 29/444; F05D 2250/52
(Continued)

(56) References Cited

U.S. PATENT DOCUMENTS 4,579,509 A * 4/1986 Jacobi ..... F01D 17/143 415/199.1
6,168,375 B1 1/2001 LaRue et al.
(Continued)

FOREIGN PATENT DOCUMENTS

CN 1121147 A 4/1996
CN 102536911 A 7/2012
(Continued)

OTHER PUBLICATIONS

International Search Report, issued in PCT/JP2014/055870, dated May 27, 2014.
(Continued)

*Primary Examiner* — Mark Laurenzi
*Assistant Examiner* — Paul Thiede
(74) *Attorney, Agent, or Firm* — Birch, Stewart, Kolasch & Birch, LLP

(57) ABSTRACT

A centrifugal fluid machine includes a rotor, a low pressure compression unit provided on one side in the axial direction of the rotor, a high pressure compression unit provided on the other side in the axial direction of the rotor, a partition wall 13 that separates the low and high pressure compression units, and a high pressure-side discharge passage 54 formed on the side of the high pressure compression unit of the partition wall 13, extending in the radial direction of the rotor, and provided along the partition wall 13, wherein the partition wall 13 has a wall body 71, a passage deformation suppression member 72 that is provided between the wall
(Continued)

body 71 and the high pressure-side discharge passage 54 and can deform the high pressure-side discharge passage 54, and an biasing mechanism 73 that is provided between the wall body 71 and the passage deformation suppression member 72.

3 Claims, 6 Drawing Sheets

(51) Int. Cl.
*F04D 29/44* (2006.01)
*F04D 29/28* (2006.01)
*F04D 29/051* (2006.01)

(52) U.S. Cl.
CPC ..... *F04D 29/286* (2013.01); *F04D 29/4206* (2013.01); *F04D 29/441* (2013.01); *F04D 29/444* (2013.01); *F05D 2250/52* (2013.01)

(58) Field of Classification Search
USPC ..... 415/199.1
See application file for complete search history.

(56) References Cited

U.S. PATENT DOCUMENTS

| | | | |
|---|---|---|---|
| 2003/0108419 | A1 | 6/2003 | Ueyama et al. |
| 2011/0280710 | A1 | 11/2011 | Mariotti |
| 2012/0156027 | A1 | 6/2012 | Merritt et al. |

FOREIGN PATENT DOCUMENTS

| | | | |
|---|---|---|---|
| CN | 202510422 | U | 10/2012 |
| EP | 0 359 514 | A2 | 3/1990 |
| JP | 60-67797 | A | 4/1985 |
| JP | 3-97599 | U | 10/1991 |
| JP | 2002-147397 | A | 5/2002 |
| JP | 2003-526037 | A | 9/2003 |
| JP | 2004-197611 | A | 7/2004 |
| JP | 2008-190487 | A | 8/2008 |
| WO | WO 00/19107 | A1 | 4/2000 |

OTHER PUBLICATIONS

Written Opinion of the International Searching Authority, issued in PCT/JP2014/055870, dated May 27, 2014.
Chinese Office Action and Search Report for Chinese Application No. 201480006022.7, dated Aug. 1, 2016, with an English translation.
Extended European Search Report dated Nov. 18, 2016 in corresponding European Patent Application No. 14 767 773.6.
Japanese Decision of a Patent Grant, dated Oct. 4, 2016, for Japanese Patent Application No. 2013-058899, with an English Translation.
English translation of the Written Opinion of the International Searching Authority (Form PCT/ISA/237), dated May 27, 2014, for International Application No. PCT/JP2014/055870.
Notification of Completion of Formalities for Registration dated Mar. 10, 2017 issued in corresponding Chinese Patent Application No. 201480006022.7 with an English Translation.
Notification of Grant of Invention Patent dated Mar. 10, 2017 issued in corresponding Chinese Patent Application No. 201480006022.7 with an English Translation.

* cited by examiner

CENTRIFUGAL FLUID MACHINE

FIELD

The present invention relates to a uniaxial multistage centrifugal fluid machine.

BACKGROUND

In the related art, a single stage centrifugal compressor is known as a centrifugal fluid machine (for example, see Patent Literature 1). This centrifugal compressor includes a diffuser passage that allows an impeller, which is attached to a turbine shaft, to communicate with scrolls formed on the discharge side of the impeller and on the outer circumferential side thereof. This diffuser passage is provided with a guiding blade unit that includes a guiding blade. The guiding blade unit protrudes into or retreats from the diffuser passage, depending on its operating mechanism. Specifically, the guiding blade unit retreats from the diffuser passage by the negative pressure in a rear air chamber. On the other hand, the guiding blade unit protrudes into the diffuser passage by being pressed by means of a protruded spring provided in the rear air chamber when the negative pressure therein is released and the air in the diffuser passage flows in through a vent hole that communicates with the rear air chamber. Thus, the centrifugal compressor can enhance efficiency in a low flow area by protruding the guiding blade unit into the diffuser passage, and prevents a decrease in efficiency in a high flow area by retreating the guiding blade unit from the diffuser passage.

CITATION LIST

Patent Literature

Patent Literature 1: JP 2004-197611 A

SUMMARY

Technical Problem

The uniaxial multistage centrifugal fluid machine is provided with a low pressure-side fluid operation unit on one side of a rotor, which is a rotating shaft, a high pressure-side fluid operation unit on the other side thereof, and a partition wall that separates the low pressure-side fluid operation unit and the high pressure-side fluid operation unit. Pressure is low on one side of the partition wall and high on the other side. Therefore, the partition wall is easy to deform from high pressure toward low pressure. Here, a fluid compressed by the high pressure-side fluid operation unit flows through a high pressure-side discharge passage formed along the partition wall. At this time, the high pressure-side discharge passage deforms to expand the passage area, when the partition wall deforms from high pressure toward low pressure. When the high pressure-side discharge passage expands, the fluid compressed by the high pressure-side fluid operation unit expands in a case where the compressed fluid flows into the discharge passage. As a result, the work efficiency of the centrifugal fluid machine decreases substantially.

Here, in Patent Literature 1, the guiding blade unit is protruded into the diffuser passage in order to enhance the efficiency in the low flow area. In a case where the partition wall deforms, however, the deformation of the high pressure-side discharge passage cannot be suppressed.

Thus, an object of the present invention is to provide a centrifugal fluid machine that can suppress the deformation of the high pressure-side discharge passage and a decrease in efficiency, even when the partition wall deforms.

Solution to Problem

According to an aspect of the present invention, a centrifugal fluid machine include: a rotor; a low pressure fluid operation unit provided on one side in an axial direction of the rotor; a high pressure fluid operation unit provided on the other side in the axial direction of the rotor; a partition wall that separates the low pressure fluid operation unit from the high pressure fluid operation unit; and a high pressure-side discharge passage formed on the side of the high pressure fluid operation unit of the partition wall, extending in a radial direction of the rotor, and provided along the partition wall. The partition wall includes: a wall body; a passage deformation suppression member provided between the wall body and the high pressure-side discharge passage to suppress deformation of the high pressure-side discharge passage; and a biasing means provided between the wall body and the passage deformation suppression member and configured to bias the passage deformation suppression member toward the high pressure-side discharge passage.

With this configuration, even when the partition wall is stretched to deform toward the low pressure fluid operation unit (low pressure-side), a passage deformation suppression member is biased toward the high pressure-side discharge passage via a biasing means. Therefore, the passage deformation suppression member can suppress the expansion of the high pressure-side discharge passage, caused by the deformation of the partition wall. Thus, a decrease in efficiency can be suppressed.

Advantageously, in the centrifugal fluid machine, the high pressure fluid operation unit includes a high pressure-side impeller that supplies a compressed fluid toward the high pressure-side discharge passage, and the biasing means has an inlet passage that flows the compressed fluid from the high pressure-side discharge passage which is disposed downstream of the high pressure-side impeller in a flow direction of the compressed fluid, into a gap between the wall body and the passage deformation suppression member.

With this configuration, the passage deformation suppression member can be biased toward the high pressure-side discharge passage by flowing the compressed fluid discharged from the high pressure fluid operation unit into a gap between a wall body and the passage deformation suppression member through an inlet passage. Thus, the compressed fluid discharged from the high pressure fluid operation unit can be utilized. Therefore, as the pressure of the compressed fluid increases by the high pressure fluid operation unit, the biasing force can be increased as well. Consequently, the passage deformation suppression member can be biased more securely toward the high pressure-side discharge passage.

Advantageously, in the centrifugal fluid machine, the biasing means further includes a return passage that returns the compressed fluid, which has flowed into the gap, toward the high pressure-side impeller.

With this configuration, the compressed fluid that has flowed into the gap can be refluxed to a high pressure-side impeller through a return passage. Therefore, a decrease in efficiency can be suppressed by a share of no discharging, to the outside, the compressed fluid flowing into the inlet passage.

Advantageously, in the centrifugal fluid machine, the biasing means further include a seal member that seals the return passage.

With this configuration, the return passage can be sealed with a sealing member. Thus, the flow of the compressed fluid into the high pressure-side impeller can be suppressed. Therefore, the compressed fluid that has flowed into the gap can be kept there. This can suppress the flow of the compressed fluid into the gap. As a result, a decrease in efficiency can be suppressed.

Advantageously, in the centrifugal fluid machine, the biasing means is an elastic member provided in the gap between the wall body and the passage deformation suppression member.

With this configuration, the passage deformation suppression member can be biased with an elastic member toward the high pressure-side discharge passage. Thus, the compressed fluid is prevented from flowing into the gap. As a result, a decrease in efficiency can be suppressed. The biasing force caused by means of the elastic member is preferably a predetermined biasing force in consideration of the deformation of the high pressure-side discharge passage in advance.

Advantageously, the centrifugal fluid machine further includes: a rotating shaft passage provided along an outer peripheral surface of the rotor; and a blowing passage that allows the rotating shaft passage to communicate with the gap between the wall body and the passage deformation suppression member. The blowing passage is provided to blow the compressed fluid flowing into the gap toward the rotating shaft passage, and to allow a blowing direction of the compressed fluid to be opposite to a rotating direction of the rotor.

With this configuration, a swirling flow, which flows into a rotating shaft passage from the high and low pressure-side impellers and swirls in the rotating direction of the rotor, can be canceled by the compressed fluid blown from a blowing passage. Accordingly, the effects of, for example, a rotor vibration caused by this swirling flow can be suppressed.

Advantageously, in the centrifugal fluid machine, the high pressure fluid operation unit has a high pressure-side impeller that supplies the compressed fluid toward the high pressure-side discharge passage, and the passage deformation suppression member is disposed outside the high pressure-side impeller in the radial direction.

With this configuration, even after the high pressure-side impeller is disposed in the wall body of the partition wall, there is no physical interference generated between the high pressure-side impeller and the passage deformation suppression member in the radial direction of the rotor. Thus, the passage deformation suppression member can be disposed easily.

Advantageously, the centrifugal fluid machine further includes a diffuser provided in the high pressure-side discharge passage. The high pressure-side discharge passage is formed from the passage deformation suppression member and a passage forming member facing the passage deformation suppression member, and both ends of the diffuser are fixed to the passage deformation suppression member and the passage forming member, respectively.

With this configuration, the diffuser, the passage deformation suppression member, and a passage forming member can be integrated by fixing the passage deformation suppression member and the passage forming member by the diffuser. Therefore, even when the passage forming member starts to deform in the direction opposite to the low pressure-side impeller, the deformation is suppressed by the passage deformation suppression member via the diffuser. Thus, the deformation of the passage forming member can be suppressed.

DESCRIPTION OF EMBODIMENTS

Embodiments according to this present invention will be described below in detail with reference to the drawings. However, this invention is not limited to these embodiments. In addition, the components in the following embodiments include those that are easy and can be replaced by those skilled in the art or those substantially identical.

First Embodiment

Figure 1:
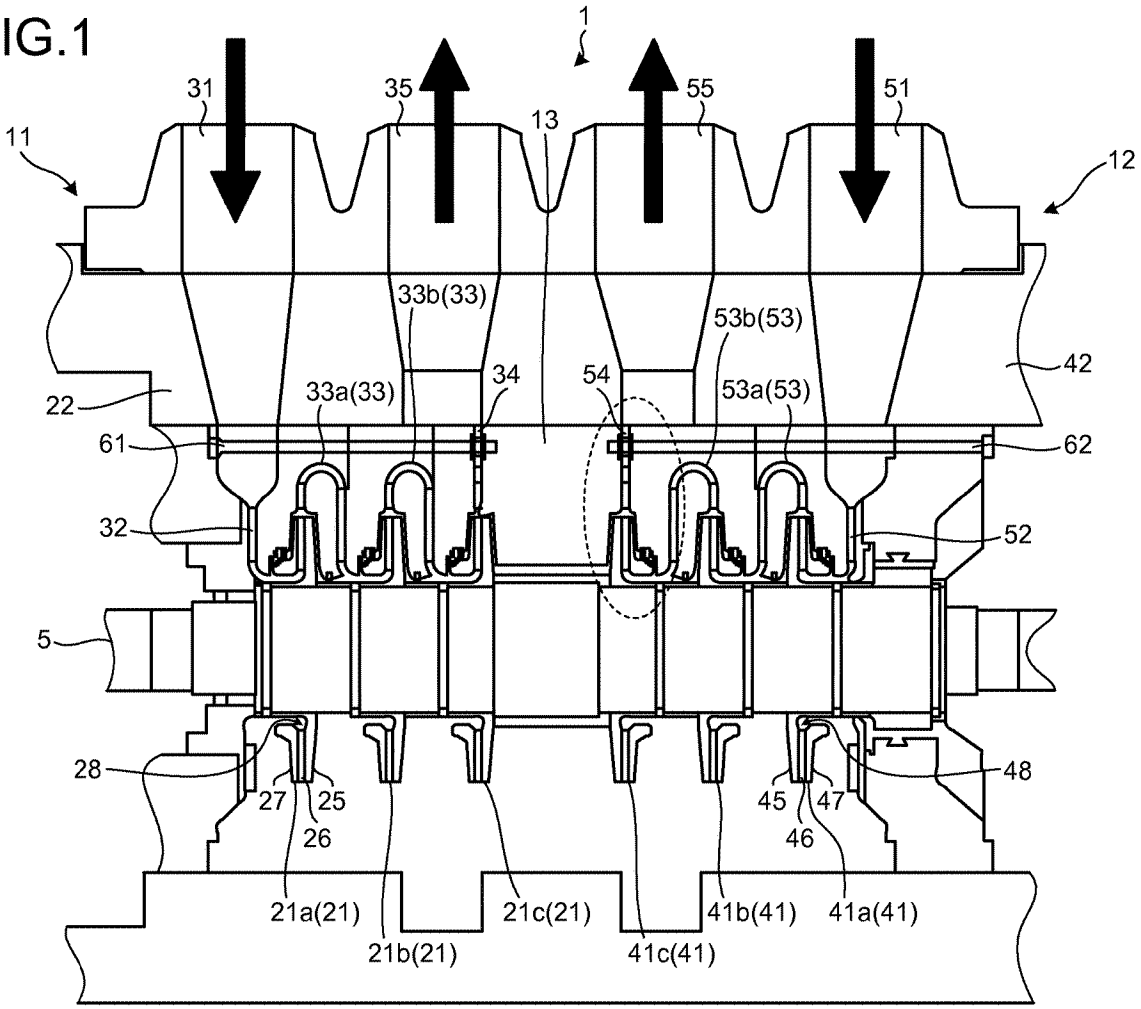
FIG. 1 is a schematic configuration diagram of a uniaxial multistage centrifugal compressor according to a first embodiment.

FIG. 1 is a schematic configuration diagram of a uniaxial multistage centrifugal compressor according to the first embodiment. As illustrated in FIG. 1, there is provided the uniaxial multistage centrifugal compressor as a centrifugal fluid machine. In the centrifugal compressor 1, a variety of gases such as air or carbon dioxide are applied as a fluid, and a gas that has been sucked is compressed to be discharged. A case where air is applied as a gas will be described below. In the first embodiment, the uniaxial multistage centrifugal compressor will be applied and described as a centrifugal fluid machine, but the centrifugal fluid machine is not limited to this configuration. For example, a uniaxial multistage centrifugal pump may be applied as a centrifugal fluid machine.

The centrifugal compressor 1 includes a rotor 5, a low pressure compression unit (low pressure fluid operating unit) 11, and a high pressure compression unit (high pressure fluid operating unit) 12. The rotor 5 serves as a rotating shaft. The low pressure compression unit 11 is provided on one side of the rotor 5 (left-hand side in the drawing). The high pressure compression unit 12 is provided on the other side of the rotor 5 (right-hand side in the drawing). The centrifugal compressor 1 also includes a partition wall 13 provided, in the axial direction of the rotor 5, between the low pressure compression unit 11 and the high pressure compression unit 12 to separate these compression units.

This centrifugal compressor 1 has a structure where the low pressure compression unit 11 and the high pressure compression unit 12 are disposed back to back across the partition wall 13, that is, a substantially symmetric structure thereacross. Therefore, the centrifugal compressor 1 offsets the force (thrust) acting in the axial direction of the rotor 5. The centrifugal compressor 1 compresses air in the low pressure compression unit 11, supplies the air compressed therein to the high pressure compression unit 12, and further compresses the compressed air therein to discharge the high pressure compressed air.

The rotor 5 is provided with its axial direction extended horizontally. A power source (not illustrated) is connected to this rotor 5, allowing rotation by means of the power transmitted from the power source. A low pressure-side impeller 21 of the low pressure compression unit 11, and a high pressure-side impeller 41 of the high pressure compression unit 12, both of which will be described below, are fixed to the rotor 5.

The low pressure compression unit 11 includes a plurality of the low pressure-side impellers 21 fixed to the rotor 5, and a low pressure-side housing 22 provided around the plurality of low pressure-side impellers 21. In the first embodiment, the plurality of low pressure-side impellers 21 is provided in three layers along the axial direction. In order from outside in the axial direction (left-hand side in the drawing) are provided a low pressure-side impeller 21*a* in the front layer, a low pressure-side impeller 21*b* in the middle layer, and a low pressure-side impeller 21*c* in the back layer (last layer).

The low pressure-side impeller 21 has a hub 25, a plurality of blades 26, and a shroud 27. The hub 25 is fixed to the rotor 5. The blades 26 are provided at a predetermined distance in the circumferential direction of the hub 25. The shroud 27 is provided on the opposite side of the hub 25 across the blades 26 In the low pressure-side impeller 21, an internal passage 28 is formed between the hub 25 and the shroud 27. Air flows from the axial direction to the radial direction through the internal passage 28. In the air flow direction, the upstream side of the internal passage 28 is formed extending in the axial direction, the downstream side thereof is formed extending in the radial direction, and the middle thereof is formed curving from the axial direction to the radial direction. Therefore, when the low pressure-side impeller 21 rotates, air is sucked in from the axial direction to be compressed, and the compressed air is discharged toward the radial direction.

The low pressure-side housing 22 rotatably stores the three-layer low pressure-side impellers 21 and one side of the rotor 5. In this low pressure-side housing 22 are formed a low pressure-side air suction port 31, a low pressure-side suction passage 32, a plurality of low pressure-side communication passages 33, a low pressure-side discharge passage 34, and a low pressure-side air discharge port 35. In FIG. 1, illustrations of passages formed in the low pressure-side housing 22 are omitted on the lower side of the illustration of the rotor 5.

The low pressure-side air suction port 31 is formed outside in the axial direction (left-hand side in the drawing) and formed extending from outside to inside in the radial direction of the rotor 5. The air that has been sucked in from the low pressure-side air suction port 31 is supplied toward the low pressure-side impeller 21*a* in the front layer. One side of the low pressure-side suction passage 32 is connected to the low pressure-side air suction port 31, while the other side thereof is connected to the upstream side of the internal passage 28 of the low pressure-side impeller 21*a* in the front layer.

The low pressure-side communication passage 33 communicates between adjacent low pressure-side impellers 21, and two communication passages 33 are formed for the three-layer low pressure-side impellers 21. In other words, a low pressure-side communication passage 33*a*, which is one of the two low pressure-side communication passages 33, connects the downstream side of the internal passage 28 in the low pressure-side impeller 21*a* in the front layer and the upstream side thereof in the low pressure-side impeller 21*b* in the middle layer. The other low pressure-side communication passage 33*b* connects the downstream side of the internal passage 28 in the low pressure-side impeller 21*b* in the middle layer and the upstream side thereof in the low pressure-side impeller 21*c* in the back layer.

One side of the low pressure-side discharge passage 34 is connected to the downstream side of the internal passage 28 of the low pressure-side impeller 21*c* in the back layer, while the other side thereof is connected to the low pressure-side air discharge port 35. The low pressure-side air discharge port 35 is formed inside in the axial direction (right-hand side in the drawing) and formed extending from inside to outside in the radial direction of the rotor 5. The low pressure-side air discharge port 35 supplies, from the low pressure-side impeller 21*c* in the back layer, the compressed air, which has been discharged through the low pressure-side discharge passage 34, toward the high pressure compression unit 12.

The high pressure compression unit 12 includes a plurality of high pressure-side impellers 41 fixed to the rotor 5, and a high pressure-side housing 42 provided around the plurality of high pressure-side impellers 41. In the first embodiment, the plurality of high pressure-side impellers 41 is provided in three layers along the axial direction. In order from outside in the axial direction (right-hand side in the drawing) are provided a high pressure-side impeller 41*a* in the front layer, a high pressure-side impeller 41*b* in the middle layer, and a high pressure-side impeller 41*c* in the back layer (last layer). In this way, the three-layer low pressure-side impellers 21 and the three-layer high pressure-side impellers 41 are disposed symmetrically in the axial direction.

The high pressure-side impeller 41 has nearly the same configuration as the low pressure-side impeller 21, and has a hub 45, a plurality of blades 46, and a shroud 47. The hub 45 is fixed to the rotor 5. The blades 46 are provided at a predetermined distance in the circumferential direction of the hub 45. The shroud 47 is provided on the opposite side of the hub 45 across the blade 46. In the high pressure-side impeller 41, an internal passage 48 is formed between the hub 45 and the shroud 47. Air flows from the axial direction to the radial direction through the internal passage 48. In the air flow direction, the upstream side of the internal passage 48 is formed extending in the axial direction, the downstream side thereof is formed extending in the radial direction, and the middle thereof is formed curving from the axial direction to the radial direction. Therefore, when the high pressure-side impeller 41 rotates, air is sucked in from the axial direction to be compressed, and the compressed air is discharged toward the radial direction.

The high pressure-side housing 42 rotatably stores the three-layer high pressure-side impellers 41 and the other side of the rotor 5. In this high pressure-side housing 42 are formed a high pressure-side air suction port 51, a high pressure-side suction passage 52, a plurality of high pressure-side communication passages 53, a high pressure-side discharge passage 54, and a high pressure-side air discharge port 55. In FIG. 1, illustrations of passages formed in the high pressure-side housing 42 are omitted on the lower side of the illustration of the rotor 5.

The high pressure-side air suction port 51 is formed outside in the axial direction (right-hand side in the drawing)

and formed extending from outside to inside in the radial direction of the rotor 5. The compressed air that has been discharged from the low pressure-side air discharge port 35 flows into the high pressure-side air suction port 51. The compressed air that has flowed into the high pressure-side air suction port 51 is supplied toward the high pressure-side impeller 41*a* in the front layer. One side of the high pressure-side suction passage 52 is connected to the high pressure-side air suction port 51, while the other side thereof is connected to the upstream side of the internal passage 48 of the high pressure-side impeller 41*a* in the front layer.

The high pressure-side communication passage 53 communicates between adjacent high pressure-side impellers 41, and two communication passages 53 are formed for the three-layer high pressure-side impellers 41. In other words, a high pressure-side communication passage 53*a*, which is one of the two high pressure-side communication passages 53, connects the downstream side of the internal passage 48 in the high pressure-side impeller 41*a* in the front layer and the upstream side of the internal passage 48 in the high pressure-side impeller 41*b* in the middle layer. The other high pressure-side communication passage 53*b* connects the downstream side of the internal passage 48 in the high pressure-side impeller 41*b* in the middle layer and the upstream side thereof in the high pressure-side impeller 41*c* in the back layer.

One side of the high pressure-side discharge passage 54 is connected to the downstream side of the internal passage 48 of the high pressure-side impeller 41*c* in the back layer, while the other side thereof is connected to the high pressure-side air discharge port 55. The high pressure-side air discharge port 55 is formed inside in the axial direction (left-hand side in the drawing) and formed extending from inside to outside in the radial direction of the rotor 5. The high pressure-side air discharge port 55 discharges, from the high pressure-side impeller 41*c* in the back layer, the compressed air that has been discharged through the high pressure-side discharge passage 54.

Thus, when the rotor 5 rotates by means of a power source, the low pressure-side impeller 21 and the high pressure-side impeller 41 rotate. When the low pressure-side impeller 21 rotates, air is sucked in from the low pressure-side air suction port 31. The sucked air flows through the low pressure-side suction passage 32 into the low pressure-side impeller 21*a* in the front layer. The low pressure-side impeller 21*a* in the front layer compresses the air that has flowed in to discharge the compressed air toward the low pressure-side communication passage 33*a*. The compressed air that has been discharged flows through the low pressure-side communication passage 33*a* into the low pressure-side impeller 21*b* in the middle layer. The low pressure-side impeller 21*b* in the middle layer compresses the compressed air that has flowed in to discharge the compressed air toward the low pressure-side communication passage 33*b*. The compressed air that has been discharged flows through the low pressure-side communication passage 33*b* into the low pressure-side impeller 21*c* in the back layer. The low pressure-side impeller 21*c* in the back layer compresses the compressed air that has flowed in to discharge the compressed air toward the low pressure-side discharge passage 34. The compressed air that has been discharged flows through the low pressure-side discharge passage 34 into the low pressure-side air discharge port 35 to be supplied therefrom to the high pressure-side air suction port 51.

When the high pressure-side impeller 41 rotates, the compressed air that has been supplied to the high pressure-side air suction port 51 is sucked in. The compressed air that has been sucked in flows through the high pressure-side suction passage 52 into the high pressure-side impeller 41*a* in the front layer. The high pressure-side impeller 41*a* in the front layer compresses the compressed air that has flowed in to discharge the compressed air toward the high pressure-side communication passage 53*a*. The air that has been discharged flows through the high pressure-side communication passage 53*a* into the high pressure-side impeller 41*b* in the middle layer. The high pressure-side impeller 41*b* in the middle layer compresses the compressed air that has flowed in to discharge the compressed air toward the high pressure-side communication passage 53*b*. The compressed air that has been discharged flows through the high pressure-side communication passage 53*b* into the high pressure-side impeller 41*c* in the back layer. The high pressure-side impeller 41*c* in the back layer compresses the compressed air that has flowed in to discharge the compressed air toward the high pressure-side discharge passage 54. The compressed air that has been discharged flows through the high pressure-side discharge passage 54 into the high pressure-side air discharge port 55 to be discharged therefrom.

The partition wall 13 is provided between the low pressure compression unit 11 and the high pressure compression unit 12. That is, the low pressure-side housing 22, the partition wall 13, and the high pressure-side housing 42 are integrated to constitute the housing of the centrifugal compressor 1.

At this time, the low pressure-side housing 22 is integrated by being fastened to the partition wall 13 with a low pressure-side connecting bolt 61. The low pressure-side connecting bolt 61 is positioned outside the low pressure-side impeller 21 in the radial direction of the rotor 5. Thus, in the low pressure-side housing 22, the outside portion of the low pressure-side impeller 21 fastened with the low pressure-side connecting bolt 61 is fixed in the radial direction of the rotor 5. On the other hand, in the low pressure-side housing 22, the inner portion of the low pressure-side connecting bolt 61, that is, the portion between the low pressure-side impellers 21 is a freed end in the radial direction of the rotor 5.

Similarly, the high pressure-side housing 42 is integrated by being fastened to the partition wall 13 with a high pressure-side connecting bolt 62. The high pressure-side connecting bolt 62 is positioned outside the high pressure-side impeller 41 in the radial direction of the rotor 5. Thus, in the high pressure-side housing 42, the outside portion of the high pressure-side impeller 41 fastened with the high pressure-side connecting bolt 62 is fixed in the radial direction of the rotor 5. On the other hand, in the high pressure-side housing 42, the inner portion of the high pressure-side connecting bolt 62, that is, the portion between the high pressure-side impellers 41 is a free end in the radial direction of the rotor 5.

In addition, on the partition wall 13 are fixed the outside portions of the impellers 21 and 41 fastened with the low pressure-side connecting bolt 61 and the high pressure-side connecting bolt 62, respectively, in the radial direction of the rotor 5. On the other hand, on the partition wall 13, the inner portions of the low pressure-side connecting bolt 61 and the high pressure-side connecting bolt 62, that is, the portion between the low pressure-side impeller 21 and the high pressure-side impeller 41 is a freed end in the radial direction of the rotor 5.

In the axial direction, the surface of this partition wall 13 on the side of the low pressure compression unit 11 (one side: left-hand side in the drawing) constitutes a part of the low pressure-side discharge passage 34, while the surface of the partition wall 13 on the side of the high pressure compression unit 12 (the other side: right-hand side in the drawing) constitutes a part of the high pressure-side discharge passage 54. In other words, the low pressure-side discharge passage 34 is provided along one side of the partition wall 13 and formed extending in the radial direction of the rotor 5. Similarly, the high pressure-side discharge passage 54 is provided along the other side of the partition wall 13 and formed extending in the radial direction of the rotor 5.

This partition wall 13 is provided with the low pressure compression unit 11 on one side and the high pressure compression unit 12 on the other side. Therefore, the partition wall 13 is easy to deform from the high pressure-side toward the low pressure-side, and in particular, the free ends are easy to deform. When the partition wall 13 deforms from the high pressure-side toward the low pressure-side, the high pressure-side discharge passage 54 deforms to expand. Thus, the partition wall 13 has a configuration illustrated in FIG. 2 in order to suppress the expanding deformation of the high pressure-side discharge passage 54.

Figure 2:
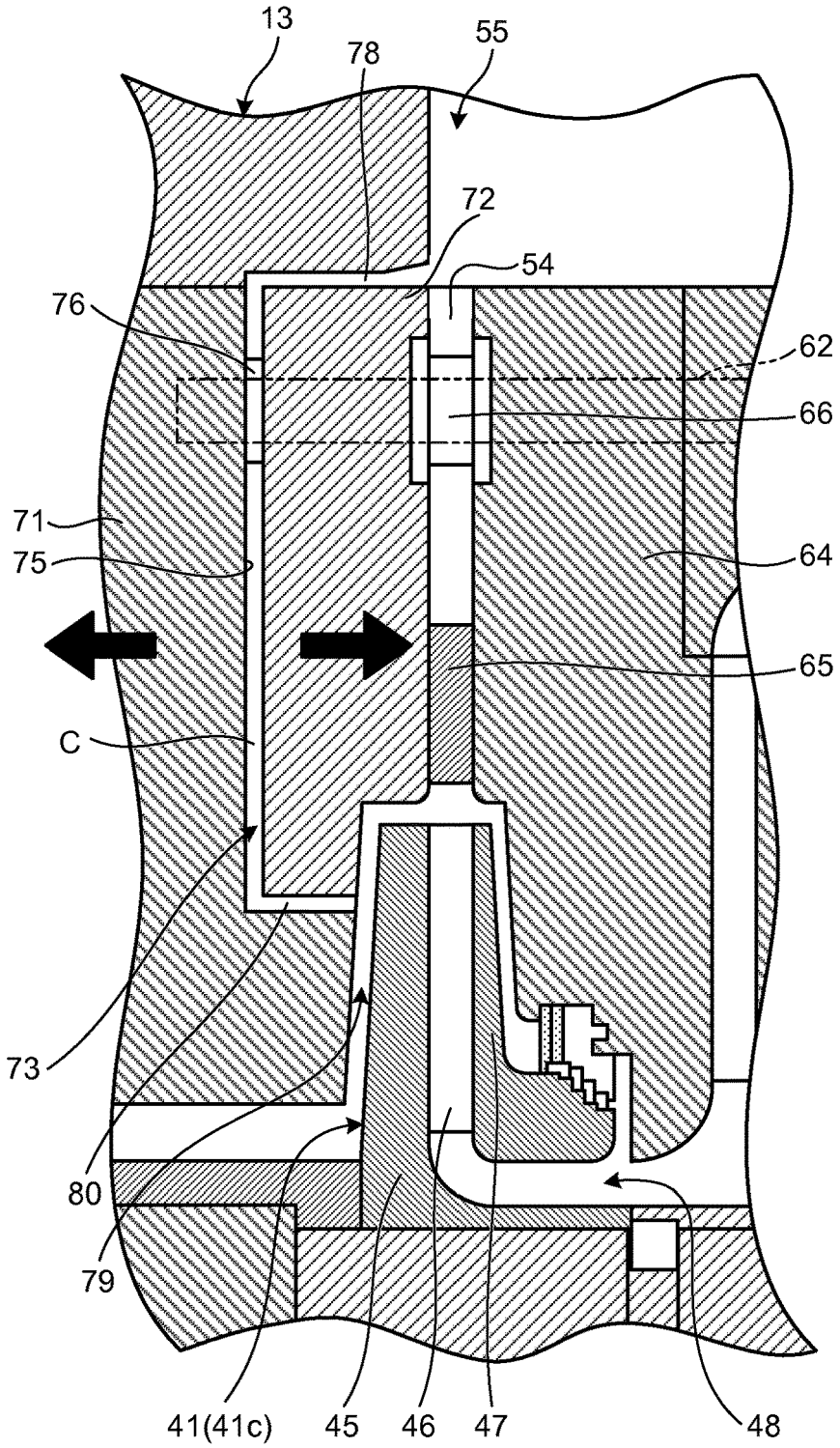
FIG. 2 is an enlarged view of the surroundings of a partition wall and a high pressure-side discharge passage of the centrifugal compressor according to the first embodiment.

Next, the configuration of the surroundings of the partition wall 13 and the high pressure-side discharge passage 54 will be described with reference to FIG. 2. FIG. 2 is an enlarged view of the surroundings of the partition wall and the high pressure-side discharge passage of the centrifugal compressor according to the first embodiment. As illustrated in FIG. 2, the partition wall 13 has a wall body 71, a passage deformation suppression member 72, and a biasing mechanism (biasing means) 73. First, prior to the description of the partition wall 13, the high pressure-side discharge passage 54 will be described.

The high pressure-side discharge passage 54 is formed by the partition wall 13 and a passage forming member 64 that constitutes the high pressure-side housing 42 facing the partition wall 13 in the axial direction. This high pressure-side discharge passage 54 is provided with a diffuser 65 and a spacer 66. The diffuser 65 guides a compressed fluid passing through the high pressure-side discharge passage 54 to the high pressure-side air discharge port 55. The other side (right-hand side in the drawing) of this diffuser 65 in the axial direction is fixed to the passage forming member 64 by means of welding or the like. On the other hand, one side of the diffuser 65 in the axial direction (left-hand side in the drawing) is not fixed to the partition wall 13, and can move toward and away from the partition wall 13. The spacer 66 maintains the high pressure-side discharge passage 54 at a predetermined width by keeping a predetermined space between the partition wall 13 and the high pressure-side housing 42. The high pressure-side connecting bolt 62 is inserted into the spacer 66.

An annular housing space 75 where the passage deformation suppression member 72 is housed is formed along the wall body 71 on the side of the high pressure compression unit 12. The housing space 75 is formed, in the radial direction, along the overlapping area from the discharge side of the high pressure-side discharge passage 54 to an end of the high pressure-side impeller 41.

The passage deformation suppression member 72 is annularly formed and provided between the wall body 71 and the high pressure-side discharge passage 54 by being housed in the annular housing space 75 formed in the wall body 71. A spacer 76 is provided between the passage deformation suppression member 72 and the housing space 75 in the axial direction. The spacer 76 forms a predetermined gap C between the passage deformation suppression member 72 and the housing space 75. The high pressure-side connecting bolt 62 is inserted into this spacer 76. The passage deformation suppression member 72 is shiftable toward the high pressure-side discharge passage 54 in the axial direction to suppress the deformation of the high pressure-side discharge passage 54. Thus, the high pressure-side connecting bolt 62 fastens integrally the passage forming member 64 of the high pressure-side housing 42, the spacer 66, the passage deformation suppression member 72, the spacer 76, and the wall body 71 in the order from outside the axial direction (right-hand side in the drawing).

The biasing mechanism 73 includes an inlet passage 78 and a return passage 80. The inlet passage 78 allows the gap C to communicate with the high pressure-side discharge passage 54. The return passage 80 allows the gap C to communicate with an impeller housing space 79 that houses the high pressure-side impeller 41*c* in the back layer. The inlet passage 78 is a passage for flowing, into the gap C, the compressed air passing through the high pressure-side discharge passage 54, that is, the compressed air that has been discharged from the high pressure-side impeller 41*c* in the back layer. One side of the inlet passage 78 is connected to the end of the gap C outside in the radial direction, while the other side thereof is connected to the end of the high pressure-side discharge passage 54 on the discharge port side, that is, the connecting part between the high pressure-side discharge passage 54 and the high pressure-side air discharge port 55. This inlet passage 78 is annularly formed, the other side of which is connected to the downstream side of the diffuser 65. The return passage 80 is a passage for returning the compressed air that has flowed into the gap C to the impeller housing space 79. One side of the return passage 80 is connected to the end of the gap C inside in the radial direction, while the other side thereof is connected to the impeller housing space 79 on the side of the hub 45 of the high pressure-side impeller 41*c*. This return passage 80 is annularly formed.

The partition wall 13 that has been configured in this way allows air to be compressed in the low pressure compression unit 11 as well as in the high pressure compression unit 12, when the rotor 5 rotates. Then, as illustrated in FIG. 2, the partition wall 13 starts to deform to stretch the wall body 71 from the high pressure-side to the low pressure-side (left-side arrow in FIG. 2). Meanwhile, the air that has been compressed is discharged from the high pressure-side impeller 41*c* in the back layer. The compressed air that has been discharged flows into the high pressure-side air discharge port 55 through the high pressure-side discharge passage 54. At this time, a part of the compressed air passing through the high pressure-side discharge passage 54 flows, through the inlet passage 78, into the gap C between the wall body 71 and the passage deformation suppression member 72. When the compressed air flows into the gap C, the increasing inner pressure of the gap C shifts the passage deformation suppression member 72 toward the high pressure-side discharge passage 54 (right-side arrow in FIG. 2). Thus, even if (the wall body 71 of) the partition wall 13 deforms toward the low pressure-side, the passage deformation suppression member 72 of the partition wall 13 shifts toward the high pressure-side discharge passage 54. The passage deformation suppression member 72 shifting toward the high pressure-side discharge passage 54 is restricted from shifting by means of the diffuser 65. As a result, the high pressure-side discharge passage 54 is maintained at a predetermined width by means of the diffuser 65. At this time, the deformation volume (shifting distance) of the wall body 71 in the absolute axial coordinate system, that is, the shifting distance before and after the deformation of the wall body 71, is equal to the shifting distance of the passage deformation suppression member 72 in the relative axial coordinate system, that is, the shifting distance of the passage deformation suppression member 72 with respect to the wall body 71.

As described above, with the configuration of the first embodiment, even if the partition wall 13 is stretched to deform by the low pressure compression unit 11, the passage deformation suppression member 72 is biased toward the high pressure-side discharge passage 54 by means of the biasing mechanism 73. Therefore, the passage deformation suppression member 72 can suppress the expansion of the high pressure-side discharge passage 54, caused by the deformation of the partition wall 13. Thus, a decrease in efficiency of the centrifugal compressor 1 can be suppressed.

With the configuration of the first embodiment, the passage deformation suppression member 72 can be biased toward the high pressure-side discharge passage 54 by flowing the compressed air discharged from the high pressure compression unit 12 into the gap C between the wall body 71 and the passage deformation suppression member 72 through the inlet passage 78. Thus, the compressed air discharged from the high pressure compression unit 12 can be utilized. Therefore, as the pressure of the compressed air increases by the high pressure compression unit 12, the biasing force can be increased as well. Consequently, the passage deformation suppression member 72 can be biased more reliably toward the high pressure-side discharge passage 54.

Furthermore, with the configuration of the first embodiment, the compressed air that has flowed into the gap C can be returned to the high pressure-side impeller 41 through the return passage 80. Therefore, a decrease in efficiency of the centrifugal compressor 1 can be suppressed by a share of no discharging the compressed air flowing into the inlet passage 78.

In the first embodiment, the other side of the inlet passage 78 is connected to the outlet end of the high pressure-side discharge passage 54, but not limited thereto. After all, as long as part of the compressed air discharged from the high pressure-side impeller 41*c* in the back layer can flow into the gap C, the other side of the inlet passage 78 may be connected to any position.

Second Embodiment

Figure 3:
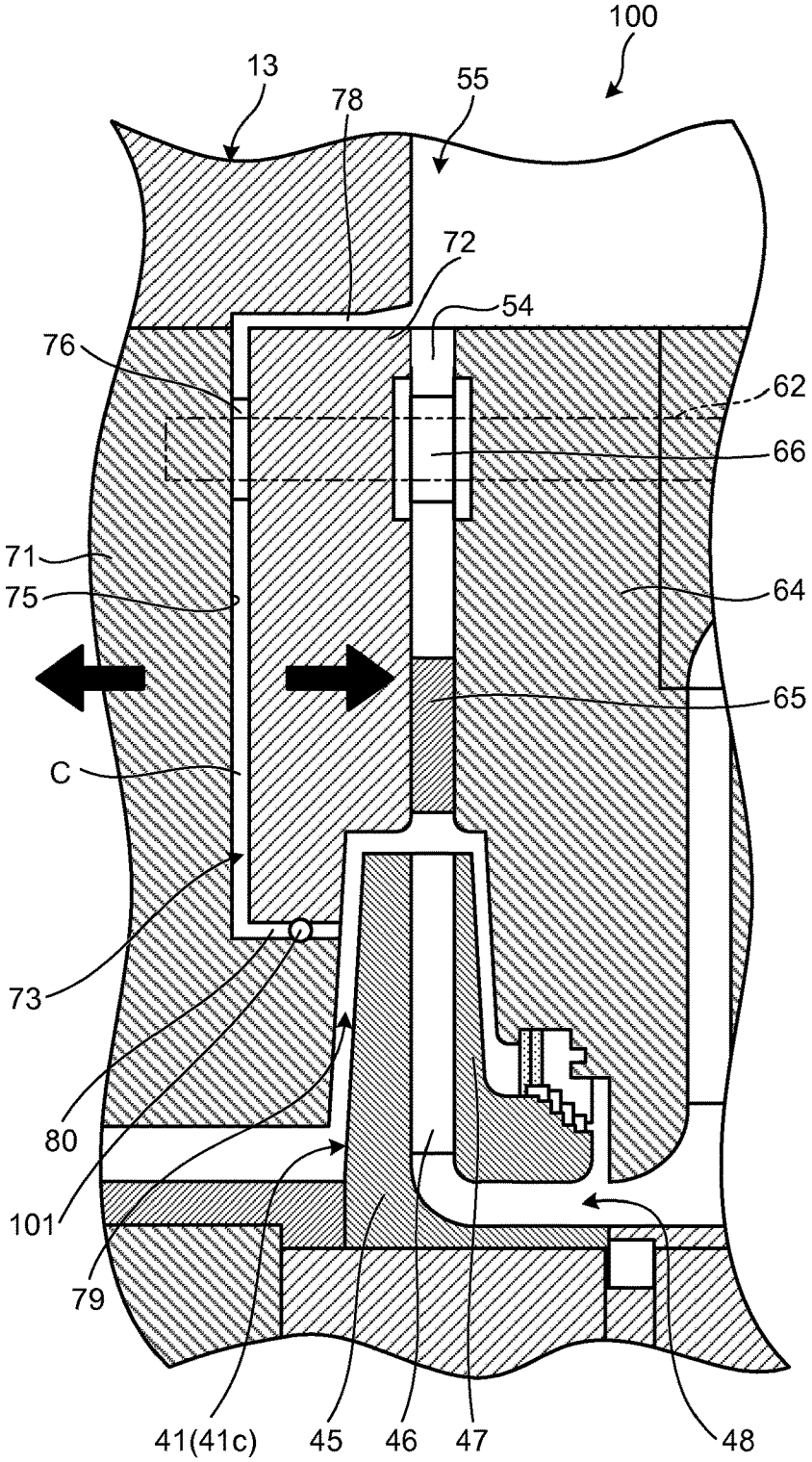
FIG. 3 is an enlarged view of the surroundings of a partition wall and a high pressure-side discharge passage of a centrifugal compressor according to a second embodiment.

Next, a centrifugal compressor 100 according to the second embodiment will be described with reference to FIG. 3. FIG. 3 is an enlarged view of the surroundings of a partition wall and a high pressure-side discharge passage of the centrifugal compressor according to the second embodiment. In the second embodiment, only differences from the first embodiment will be described to avoid descriptions overlapping with those in the first embodiment. In the centrifugal compressor 100 of the second embodiment, a biasing mechanism 73 has a seal member 101 to seal a return passage 80.

As illustrated in FIG. 3, the annularly formed return passage 80 is provided with the seal member 101, such as an O-ring, provided along the circumferential direction. This seal member 101 seals the return passage 80, while allowing a passage deformation suppression member 72 to shift with respect to a wall body 71. The seal member 101 is not limited to the O-ring, as long as it can seal the return passage 80 while allowing the passage deformation suppression member 72 to shift. For example, a labyrinth seal or a brush seal may be applied.

As described above, according to the configuration of the second embodiment, the return passage 80 can be sealed with the seal member 101. Thus, the flow of the compressed air into a high pressure-side impeller 41 can be suppressed. Therefore, the compressed air that has flowed into a gap C can be kept there. This can suppress the flow of the compressed air into the gap C. As a result, a decrease in efficiency of the centrifugal compressor 100 can be further suppressed.

Third Embodiment

Figure 4:
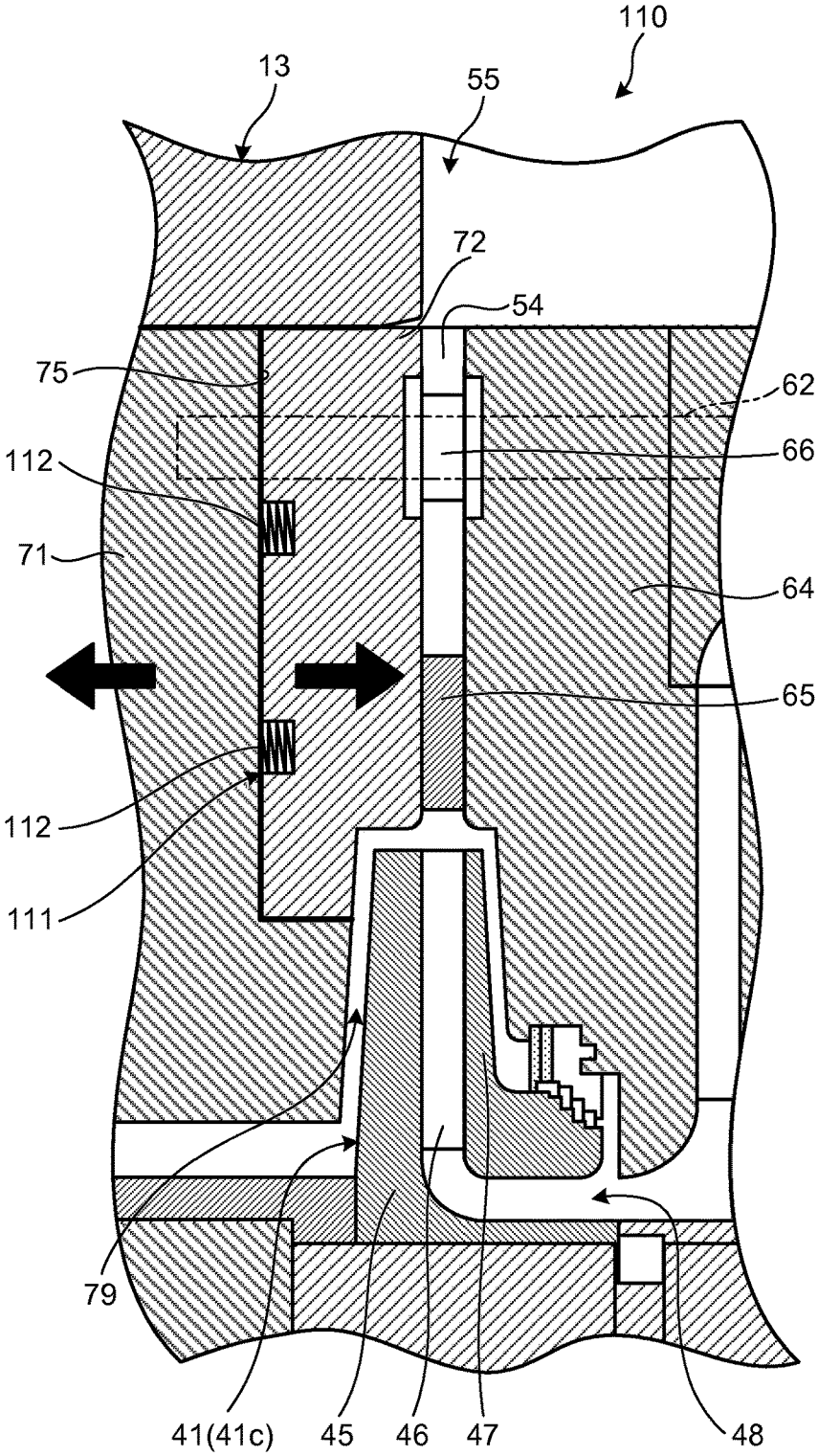
FIG. 4 is an enlarged view of the surroundings of a partition wall and a high pressure-side discharge passage of a centrifugal compressor according to a third embodiment.

Next, a centrifugal compressor 110 according to the third embodiment will be described with reference to FIG. 4. FIG. 4 is an enlarged view of the surroundings of a partition wall and a high pressure-side discharge passage of the centrifugal compressor according to the third embodiment. Also in the third embodiment, only differences from the first and second embodiments will be described to avoid descriptions overlapping with those in the first and second embodiments. In the first and second embodiments, the configuration where the biasing mechanism 73 includes the inlet passage 78 shifts the passage deformation suppression member 72 toward the high pressure-side by means of the pressure (discharge pressure) of the compressed air. In the third embodiment, a configuration where a biasing mechanism 111 includes an elastic member 112 shifts a passage deformation suppression member 72 toward the high pressure-side by means of the biasing force of the elastic member 112.

As illustrated in FIG. 4, the biasing mechanism 111 of the centrifugal compressor 110 according to the third embodiment has the elastic member 112 such as a spring provided between a wall body 71 and the passage deformation suppression member 72. In other words, the biasing mechanism 111 has no need to flow the compressed air into a gap C between the wall body 71 and the passage deformation suppression member 72. Therefore, the passage deformation suppression member 72 has only to be shiftable toward the high pressure-side with respect to the wall body 71, enabling a configuration without the formation of the gap C, inlet passage 78, and return passage 80 to eliminate the spacer 76. The elastic member 112 is provided between the wall body 71 and the passage deformation suppression member 72 to bias the passage deformation suppression member 72 toward the high pressure-side discharge passage 54. At this point, the biasing force of the elastic member 112 has been set to become a predetermined biasing force in consideration of the deformation of the high pressure-side discharge passage in advance. That is, the elastic member 112 is configured to generate, even if the partition wall 13 deforms, a biasing force that can shift the passage deformation suppression member 72 toward the high pressure-side to maintain the high pressure-side discharge passage 54 at a predetermined width by means of the diffuser 65.

As described above, according to the configuration of the third embodiment, the elastic member 112 can bias the passage deformation suppression member 72 toward the high pressure-side discharge passage 54. Thus, the compressed air is prevented from flowing into the gap C. As a result, a decrease in efficiency of the centrifugal compressor 110 can be suppressed.

Fourth Embodiment

Figure 5:
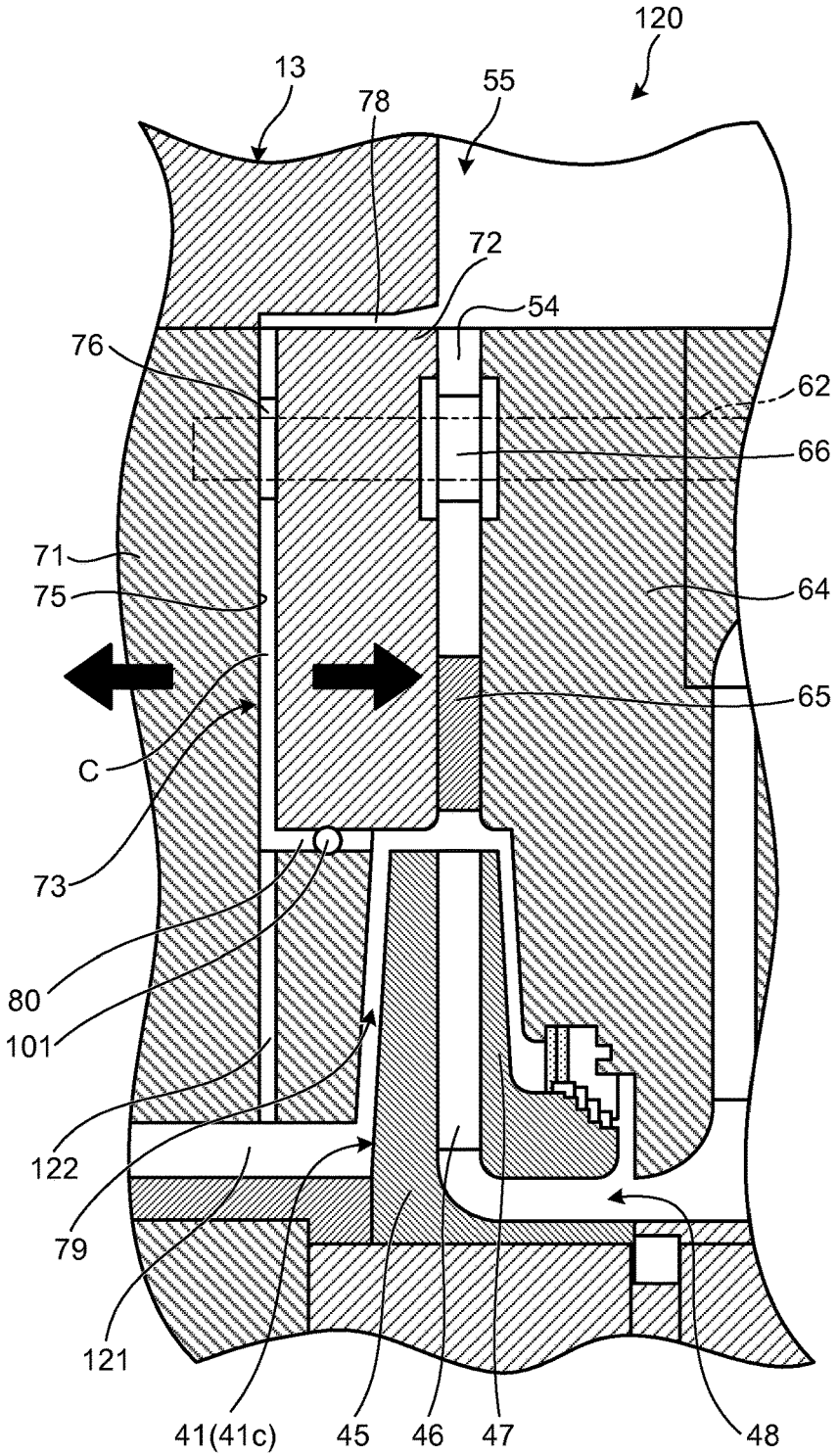
FIG. 5 is an enlarged view of the surroundings of a partition wall and a high pressure-side discharge passage of a centrifugal compressor according to a fourth embodiment.
Figure 6:
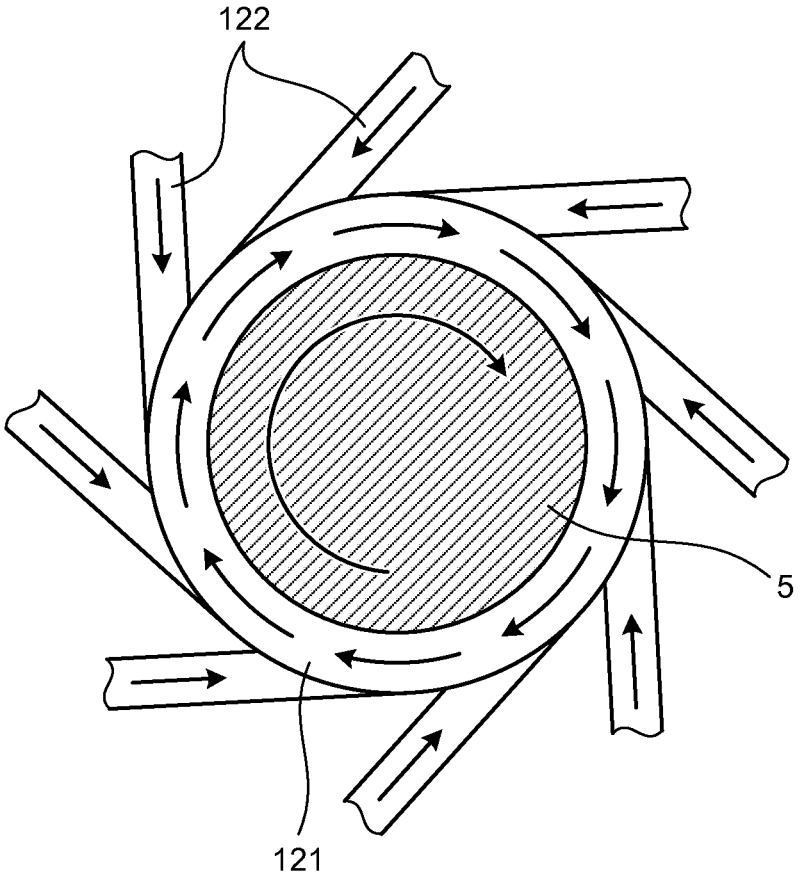
FIG. 6 is a pattern diagram of the surroundings of a rotating shaft passage and a blowing passage, as viewed from the axial direction of a rotor.

Next, a centrifugal compressor 120 according to the fourth embodiment will be described with reference to FIGS. 5 and 6. FIG. 5 is an enlarged view of the surroundings of a partition wall and a high pressure-side discharge passage of the centrifugal compressor according to the fourth embodiment. FIG. 6 is a pattern diagram of the surroundings of a rotating shaft passage and a blowing passage, as viewed from the axial direction of a rotor. Also in the fourth embodiment, only differences from the first to third embodiments will be described to avoid descriptions overlapping with those in the first to third embodiments. In the first to third embodiments, the housing space 75 of the passage deformation suppression member 72 is formed, in the radial direction, from the discharge side of the high pressure-side discharge passage 54 to the area overlapping with the end of the high pressure-side impeller 41. Therefore, in the first to third embodiments, the annular passage deformation suppression member 72 housed in the housing space 75 overlaps the high pressure-side impeller 41*c*, as viewed from the axial direction. In contrast, in the centrifugal compressor 120 of the fourth embodiment, a high pressure-side impeller 41 is disposed inside an annular passage deformation suppression member 72. The centrifugal compressor 120 according to the fourth embodiment will be described below. The centrifugal compressor 120 according to the fourth embodiment has a configuration based on the centrifugal compressor 100 of the second embodiment.

As illustrated in FIG. 5, in the centrifugal compressor 120 according to the fourth embodiment, a housing space 75 formed in a wall body 71 is formed from outside in the radial direction of the high pressure-side impeller 41 to the discharge side of the high pressure-side discharge passage 54.

The passage deformation suppression member 72 is annularly formed and provided between the wall body 71 and the high pressure-side discharge passage 54 by being housed in the annular housing space 75 formed in the wall body 71. Thus, the high pressure-side impeller 41 is disposed inside the annular passage deformation suppression member 72. That is, the inner diameter of the annular passage deformation suppression member 72 is larger than the outer diameter of the high pressure-side impeller 41. The passage deformation suppression member 72 is disposed outside in the radial direction of the high pressure-side impeller 41.

A biasing mechanism 73 includes an inlet passage 78 and a return passage 80. The inlet passage 78 is the same as that in the first embodiment, and thus will not be described. The annular passage deformation suppression member 72 is disposed outside in the radial direction of the high pressure-side impeller 41. Therefore, one side of the return passage 80 is connected to an end of a gap C inside in the radial direction, while the other side thereof is connected to an impeller housing space 79 outside in the radial direction of a high pressure-side impeller 41*c*. Then, as in the second embodiment, this return passage 80 is provided with a seal member 101 such as an O-ring provided along the circumferential direction.

In the centrifugal compressor 120 according to the fourth embodiment, the other side in the axial direction (right-hand side in the drawing) of the diffuser 65 provided between the passage deformation suppression member 72 and a passage forming member 64 is fixed to the passage forming member 64 by means of welding or the like, and one side thereof in the axial direction (left-hand side in the drawing) is fixed to (the passage deformation suppression member 72 of) the partition wall 13 by means of welding or the like.

Furthermore, in the centrifugal compressor 120 according to the fourth embodiment, an insertion hole to insert a rotor 5 is formed in the wall body 71 of the partition wall 13. Between the rotor 5 and the insertion hole, a rotating shaft passage 121 is provided along the outer peripheral surface of the rotor 5. The rotating shaft passage 121 is formed over the entire circumference of the rotor 5. On the side of the high pressure compression unit 12 in the axial direction, the rotating shaft passage 121 communicates with the impeller housing space 79 on the high pressure-side. Air circulates through the rotating shaft passage 121, and the pressure therein is lower than that in the high pressure-side discharge passage 54.

As illustrated in FIG. 6, when the rotor 5 rotates, air circulating through the rotating shaft passage 121 becomes a swirling flow toward the rotational direction of the rotor 5. Here, as illustrated in FIGS. 5 and 6, in the wall body 71 is formed a plurality of blowing passages 122 that allows the rotating shaft passage 121 to communicate with the gap C between the wall body 71 and the passage deformation suppression member 72. The blowing passage 122 blows the compressed air flowing into the gap C toward the rotating shaft passage 121. The plurality of blowing passages 122 is provided at a predetermined distance along the circumferential direction of the rotating shaft passage 121. The blowing passage 122 is provided along the tangential direction of the rotating shaft passage 121 such that the direction of blowing the compressed air is opposite to the swirling direction of the swirling flow that swirls in the rotating shaft passage 121. Thus, the compressed air that has been blown from the plurality of blowing passages 122 is blown in the direction opposite to the swirling direction of the swirling flow (rotational direction of the rotor 5). As a result, the swirling flow can be canceled.

As described above, according to the configuration of the fourth embodiment, the passage deformation suppression member 72 can, in the radial direction of the rotor 5, be disposed outside the high pressure-side impeller 41 in the radial direction. Therefore, even after the high pressure-side impeller 41 is disposed in the wall body 71 of the partition wall 13, there is no physical interference generated between the high pressure-side impeller 41 and the passage deformation suppression member 72 in the radial direction. Thus, the passage deformation suppression member 72 can be disposed easily.

In the configuration of the fourth embodiment, the diffuser 65, the passage deformation suppression member 72, and the passage forming member 64 can be integrated by fixing the passage deformation suppression member 72 and the passage forming member 64 by the diffuser 65. Therefore, even when the passage forming member 64 starts to deform, the deformation is suppressed by the passage deformation suppression member 72 via the diffuser 65. Thus, the deformation of the passage forming member 64 can be suppressed.

In addition, according to the configuration of the fourth embodiment, the plurality of blowing passages 122 can be connected to the rotating shaft passage 121. Therefore, the swirling flow in the rotating shaft passage 121 can be canceled by the compressed air blown from the blowing passage 122 to suppress the effects of, for example, vibration of the rotor 5 caused by the swirling flow. The rotating shaft passage 121 and the plurality of blowing passages 122 may be provided in the low pressure compression unit 11.

In the first to fourth embodiments, the biasing mechanisms 73 and 111 shift the passage deformation suppression member 72 toward the high pressure-side discharge passage 54 by means of the pressure in the gap C or the biasing force of the elastic member 112, but are not limited to this configuration. After all, as long as the biasing means can shift the passage deformation suppression member 72 toward the high pressure-side discharge passage 54, any configuration may be applied.

The configurations of the first to fourth embodiments may be combined appropriately. For example, the rotating shaft passage 121 and the plurality of blowing passages 122 in the fourth embodiment may be applied in the first embodiment. In addition, the configuration of the annular passage deformation suppression member 72 in the fourth embodiment may be applied in the third embodiment.

REFERENCE SIGNS LIST

1 CENTRIFUGAL COMPRESSOR
5 ROTOR
11 LOW PRESSURE COMPRESSION UNIT
12 HIGH PRESSURE COMPRESSION UNIT
13 PARTITION WALL
21 LOW PRESSURE-SIDE IMPELLER
22 LOW PRESSURE-SIDE HOUSING
25 LOW PRESSURE-SIDE IMPELLER HUB
26 LOW PRESSURE-SIDE IMPELLER BLADE
27 LOW PRESSURE-SIDE IMPELLER SHROUD
28 LOW PRESSURE-SIDE IMPELLER INTERNAL PASSAGE
31 LOW PRESSURE-SIDE AIR SUCTION PORT
32 LOW PRESSURE-SIDE SUCTION PASSAGE
33 LOW PRESSURE-SIDE COMMUNICATION PASSAGE
34 LOW PRESSURE-SIDE DISCHARGE PASSAGE
35 LOW PRESSURE-SIDE AIR DISCHARGE PORT
41 HIGH PRESSURE-SIDE IMPELLER
42 HIGH PRESSURE-SIDE HOUSING
45 HIGH PRESSURE-SIDE IMPELLER HUB
46 HIGH PRESSURE-SIDE IMPELLER BLADE
47 HIGH PRESSURE-SIDE IMPELLER SHROUD
48 HIGH PRESSURE-SIDE IMPELLER INTERNAL PASSAGE
51 HIGH PRESSURE-SIDE AIR SUCTION PORT
52 HIGH PRESSURE-SIDE SUCTION PASSAGE
53 HIGH PRESSURE-SIDE COMMUNICATION PASSAGE
54 HIGH PRESSURE-SIDE DISCHARGE PASSAGE
55 HIGH PRESSURE-SIDE AIR DISCHARGE PORT
61 LOW PRESSURE-SIDE CONNECTING BOLT
62 HIGH PRESSURE-SIDE CONNECTING BOLT
64 PASSAGE FORMING MEMBER
65 DIFFUSER
66 SPACER
71 WALL BODY
72 PASSAGE DEFORMATION SUPPRESSION MEMBER
73 BIASING MECHANISM
75 PASSAGE DEFORMATION SUPPRESSION MEMBER HOUSING SPACE
76 SPACER
78 INLET PASSAGE
79 IMPELLER HOUSING SPACE
80 RETURN PASSAGE
100 CENTRIFUGAL COMPRESSOR (SECOND EMBODIMENT)
101 SEAL MEMBER (SECOND EMBODIMENT)
110 CENTRIFUGAL COMPRESSOR (THIRD EMBODIMENT)
111 BIASING MECHANISM (THIRD EMBODIMENT)
112 ELASTIC MEMBER (THIRD EMBODIMENT)
120 CENTRIFUGAL COMPRESSOR (FOURTH EMBODIMENT)
121 ROTATING SHAFT PASSAGE
122 BLOWING PASSAGE
C GAP

The invention claimed is:

1. A centrifugal fluid machine comprising:
a rotor;
a low pressure fluid operation unit provided on one side in an axial direction of the rotor;
a high pressure fluid operation unit provided on the other side in the axial direction of the rotor;
a partition wall that separates the low pressure fluid operation unit from the high pressure fluid operation unit; and
a high pressure-side discharge passage formed on the side of the high pressure fluid operation unit of the partition wall, extending in a radial direction of the rotor, and provided along the partition wall,
wherein the partition wall comprises:
a wall body;
a passage deformation suppression member provided between the wall body and the high pressure-side discharge passage to suppress deformation of the high pressure-side discharge passage; and
a biasing means provided between the wall body and the passage deformation suppression member and configured to bias the passage deformation suppression member toward the high pressure-side discharge passage,
wherein the high pressure fluid operation unit includes a high pressure-side impeller that supplies a compressed fluid toward the high pressure-side discharge passage, and
wherein the biasing means has an inlet passage that flows the compressed fluid from the high pressure-side discharge passage which is disposed downstream of the high pressure-side impeller in a flow direction of the compressed fluid, into a gap between the wall body and the passage deformation suppression member,
wherein the centrifugal fluid machine further comprises:
a rotating shaft passage provided along an outer peripheral surface of the rotor; and
a blowing passage that allows the rotating shaft passage to communicate with the gap between the wall body and the passage deformation suppression member,
wherein the blowing passage is provided to blow the compressed fluid flowing into the gap toward the rotating shaft passage, and to allow a blowing direction of the compressed fluid to be opposite to a rotating direction of the rotor.

2. The centrifugal fluid machine according to claim 1, wherein
the passage deformation suppression member is disposed outside the high pressure-side impeller in the radial direction.

3. A centrifugal fluid machine comprising:
a rotor;
a low pressure fluid operation unit provided on one side in an axial direction of the rotor;
a high pressure fluid operation unit provided on the other side in the axial direction of the rotor;
a partition wall that separates the low pressure fluid operation unit from the high pressure fluid operation unit; and
a high pressure-side discharge passage formed on the side of the high pressure fluid operation unit of the partition wall, extending in a radial direction of the rotor, and provided along the partition wall,
wherein the partition wall comprises:
a wall body;

a passage deformation suppression member provided between the wall body and the high pressure-side discharge passage to suppress deformation of the high pressure-side discharge passage; and a biasing means provided between the wall body and the passage deformation suppression member and configured to bias the passage deformation suppression member toward the high pressure-side discharge passage, wherein the centrifugal fluid machine further comprises a diffuser provided in the high pressure-side discharge passage, wherein the high pressure-side discharge passage is formed from the passage deformation suppression member and a passage forming member facing the passage deformation suppression member, and both ends of the diffuser are fixed to the passage deformation suppression member and the passage forming member, respectively, wherein the high pressure fluid operation unit includes a high pressure-side impeller that supplies a compressed fluid toward the high pressure-side discharge passage, and wherein the biasing means has an inlet passage that flows the compressed fluid from the high pressure-side discharge passage which is disposed downstream of the high pressure-side impeller in a flow direction of the compressed fluid, into a gap between the wall body and the passage deformation suppression member, wherein the centrifugal fluid machine further comprises:

a rotating shaft passage provided along an outer peripheral surface of the rotor; and a blowing passage that allows the rotating shaft passage to communicate with the gap between the wall body and the passage deformation suppression member, wherein the blowing passage is provided to blow the compressed fluid flowing into the gap toward the rotating shaft passage, and to allow a blowing direction of the compressed fluid to be opposite to a rotating direction of the rotor.

* * * * *